US007406802B2

(12) United States Patent
Stackenwalt et al.

(10) Patent No.: US 7,406,802 B2
(45) Date of Patent: Aug. 5, 2008

(54) PANEL STRUCTURES AND MOUNTING THEREFORE

(75) Inventors: Richard D. Stackenwalt, Dallastown, PA (US); Eric Krantz-Lilienthal, Lancaster, PA (US); Guillaume Martin, Paris (FR)

(73) Assignee: AWI Licensing Company, Wilmington, DE (US)

( * ) Notice: Subject to any disclaimer, the term of this patent is extended or adjusted under 35 U.S.C. 154(b) by 505 days.

(21) Appl. No.: 10/802,620

(22) Filed: Mar. 17, 2004

(65) Prior Publication Data

US 2004/0182022 A1 Sep. 23, 2004

Related U.S. Application Data

(60) Provisional application No. 60/456,005, filed on Mar. 19, 2003.

(51) Int. Cl.
*E04B 1/00* (2006.01)

(52) U.S. Cl. ..... 52/222; 52/506.06; 52/22; 52/231; 52/245; 52/291

(58) Field of Classification Search ..... 52/22, 52/222, 506.01, 737.1, 506.07, 585.1, 506.06, 52/506.08, 223.6, 231, 245, 291; 403/294, 403/297, 326, 327, 328, 360
See application file for complete search history.

(56) References Cited

U.S. PATENT DOCUMENTS

| | | | | |
|---|---|---|---|---|
| 3,968,609 | A * | 7/1976 | Deutsch et al. | 52/245 |
| 4,433,700 | A * | 2/1984 | Dohet | 135/97 |
| 4,571,897 | A * | 2/1986 | Kerr | 52/13 |
| 4,860,504 | A * | 8/1989 | Lawrence | 52/86 |
| 5,027,564 | A * | 7/1991 | Lechner | 52/2.23 |
| 5,595,233 | A * | 1/1997 | Gower | 160/232 |
| 7,127,851 | B2 * | 10/2006 | Morris | 52/22 |
| 2003/0019179 | A1 | 1/2003 | Colson et al. | 52/506.06 |
| 2003/0159372 | A1 * | 8/2003 | Motro | 52/202 |

FOREIGN PATENT DOCUMENTS

| | | |
|---|---|---|
| WO | WO 03/008728 | 1/2003 |
| WO | WO 03/008729 | 1/2003 |

OTHER PUBLICATIONS

European Search Report Communication—Application No. EP 04 00 6589 dated Oct. 24, 2005.

* cited by examiner

*Primary Examiner*—Richard E. Chilcot, Jr.
*Assistant Examiner*—William V Gilbert

(57) ABSTRACT

A panel structure including a flexible panel, at least one edge strip and mounting hardware is provided. Also provided is a method of configuring the panel structure. The edge strip has at least one mounting member receiving area provided thereon. The mounting member receiving area is dimensioned to receive the mounting hardware therein. The mounting hardware cooperates with the edge strip to suspend and mount the flexible panel.

When installed, the panel structure provides a canopy-like visual element to a space in which it is suspended or mounted. The panel structure may be suspended or mounted in various configurations having different degrees of flex or curvature. The panel structure can be installed easily and reconfigured easily to suit the user.

7 Claims, 8 Drawing Sheets

FIG 5
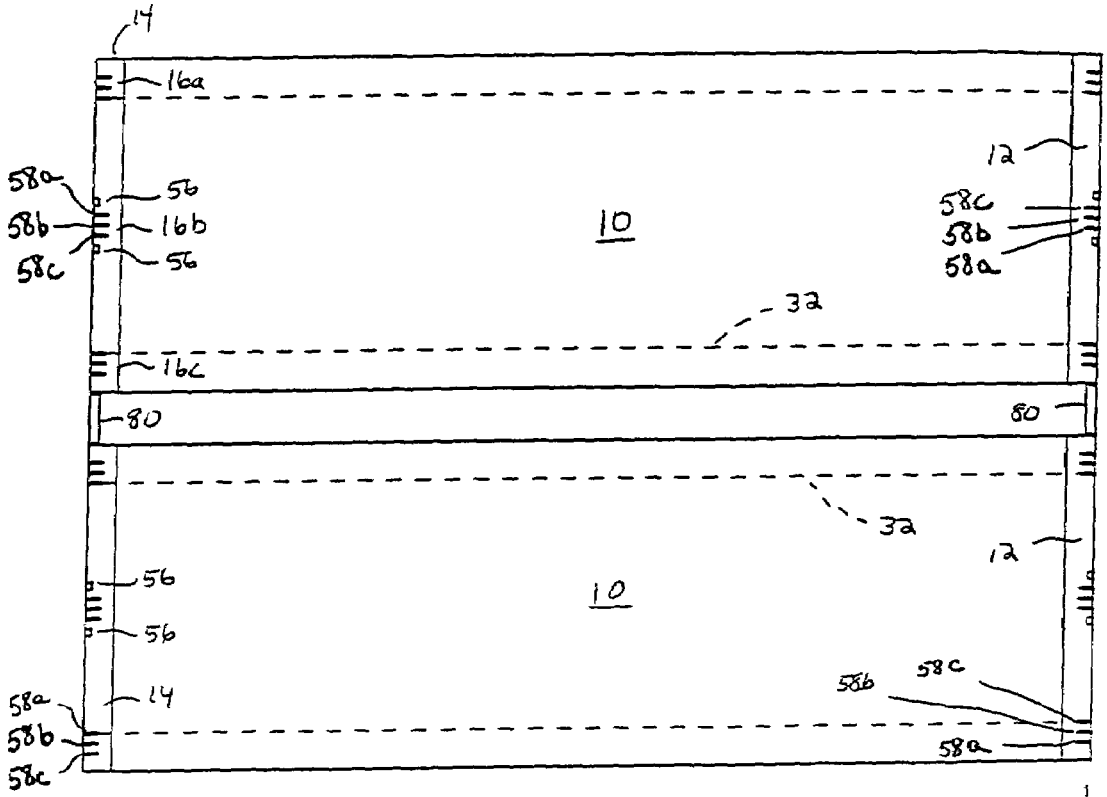
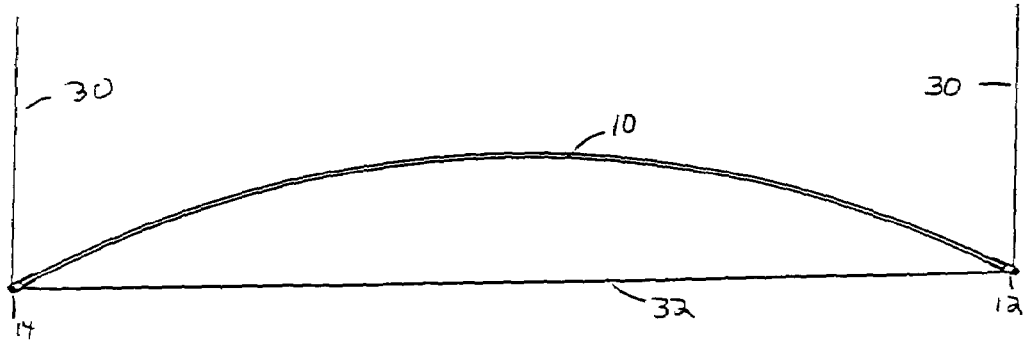
FIG 4

PANEL STRUCTURES AND MOUNTING THEREFORE

CROSS REFERENCE TO RELATED APPLICATION

This application claims the benefit under 35 U.S.C. §119 (e) of U.S. provisional application Ser. No. 60/456,005, filed Mar. 19, 2003.

BACKGROUND

The present invention relates generally to aesthetic structures or panels which are supported and/or hung from the primary building structure. In particular, the invention is directed to the mounting members which cooperate with the panels.

Traditional suspended ceiling structures formed from suspended grids of acoustically absorbent tiles are commonly found in commercial work spaces such as professional offices. While such structures provide a pleasant and acoustically absorbent space, designers and architects who desire to create the feel of an open loft space often object to the uniformity and lowered ceiling height created by conventional drop ceilings. Thus, more and more businesses are opting for so-called open plenum ceiling designs. In the open plenum, no suspended ceiling is provided that screens the entire hard deck or hard ceiling along with the HVAC duct work, wiring and the like. Rather, these structural elements are exposed. Open plenum ceilings are more commonly found in retail stores and similar commercial settings, but also can be found in office spaces.

In office spaces where open plenum ceilings are found, individual offices within the office space often are created using reconfigurable partitions that may be considerably lower than the hard ceiling. Whether in an office space or some other in-door space, the combination of an open plenum design with partitions that do not rise to the ceiling hard deck tends to leave the space unstructured and, consequently, less useful and aesthetically pleasing than it might otherwise be with some panel structure that helps to define and differentiate the space.

To differentiate a space and to create a more interesting visual in a loft style space or open plenum design, architects sometimes will specify that an open loft space be provided with customized panel structures suspended from the ceiling to differentiate the space within the room. Such suspended panel structures not only can delineate the space but also may dampen extraneous noise and create an interesting visual. Unfortunately, such panel structures must be preformed into the desired shape, thus making them difficult to ship or mass produce. Consequently, such panel structures tend to be made only as customized pieces. Such customization leads to considerable expense to fabricate such a suspended panel structure and its framing.

Similar panel structures can also be mounted on wall surfaces to create interesting visuals and dampen noise. These wall mounted devices have similar problems as described above.

In order to provide an alternative, Armstrong World Industries designed a panel structure that is suspended within a space and includes a flexible panel maintained in a flexed configuration. The panel structure is described in co-pending international patent applications PCT/US02/23040, PCT/US02/22945 and PCT/US02/22947, all which claim priority from U.S. Provisional Patent Application Ser. No. 60/306,516. The panel structure includes a support member which supports the flexible panel and is connected to a biasing member. The biasing member cooperates with a portion of the flexible panel to maintain the panel in a flexed configuration. The configuration allows the elements to be easily interchanged to provide a variety of configurations. Consequently, customization of many of the pieces is not required. However, the attachment of the support and biasing members to the panels can be cumbersome and can limit the flexibility of the system. In addition, the visuals of the panel structure described are limited by the manner in which the support and biasing members are attached to the panels. Therefore, there is a need for a system in which the mounting members allow maximum flexibility in the positioning of the panel structure and enhance the visual appearance of the system.

SUMMARY

The invention is directed to a suspended ceiling structure which may adds functionality, such as lighting and acoustics, as well as aesthetics to a space. The ceiling structure includes a panel structure which has a flexible panel and an edge strip cooperating with an edge portion of the flexible panel. The edge strip has at least one mounting member receiving area provided thereon. The mounting member receiving area is dimensioned to receive mounting hardware therein. The mounting hardware, herein also referred to as mounting members, cooperates with the flexible panel to maintain the flexible panel.

One type of mounting member is a biasing member. The biasing member cooperates with the flexible panel to retain the flexible panel in stressed position. Another type of mounting member is a support member. The support member cooperates with the flexible panel to suspend the flexible panel from a surface. A third type of mounting member which can extend from the mounting member receiving area is a seismic member. The seismic member cooperates with the flexible panel to maintain the flexible panel in a suspended condition as seismic activity occurs.

The invention is also directed to the use of a spacer between adjacent panel structures. The spacer cooperates with a pin which extends from the panel structure. As a second panel structure is moved proximate a first panel structure, the pin and spacer maintain the second panel structure in proper position relative the first panel structure.

The panel structure can also be mounted to a wall or other similar surface using a mounting bracket. The mounting bracket cooperates with a pin which extends from the panel structure. As the mounting bracket is mounted to a surface, such as a wall, the pin and mounting bracket cooperate to maintain the panel structure in position relative to a surface. In addition, when panel structures are positioned adjacent to one another at a surface location, the pin and mounting bracket cooperate to maintain the adjacent panel structures in proper position.

The invention is also directed to a method of configuring a panel structure. The method includes engaging a first edge strip with a first edge of a flexible panel. The first edge strip has at least one mounting member receiving area. A second edge strip is then moved into engagement with a second edge of the flexible panel. The second edge strip has a second mounting member receiving area. A biasing member is then inserted into the at least one mounting member receiving area of the first edge strip. The flexible panel is then stressed or flexed and the biasing member is inserted into the at least one mounting member receiving area of the second edge strip. The flexible panel is then allowed to return toward its unflexed condition. As the flexible panel moves toward the unflexed position, the biasing member cooperates with the flexible panel to prevent the flexible panel from returning to an unflexed condition.

The method also includes the steps of inserting support members into the at least one mounting member receiving areas of the first and second edge strips. This allows the support members to cooperate with the flexible panel in order to suspend the flexible panel from a surface. Additionally, a seismic member can also be inserted into the at least one mounting member receiving areas of the first and second edge strips. This allows the seismic member to cooperate with the flexible panel to maintain the flexible panel in a suspended condition during seismic activity.

These and other features of the present invention will become apparent upon reading the following detailed description, when taken in conjunction with the accompanying drawings that are briefly described as follows.

BRIEF DESCRIPTION OF THE DRAWINGS

FIG. 4 is a side view of a panel structure shown in FIG. 3.

FIG. 5 is a top view of a panel structure shown in FIG. 3.

DETAILED DESCRIPTION

Figure 3:
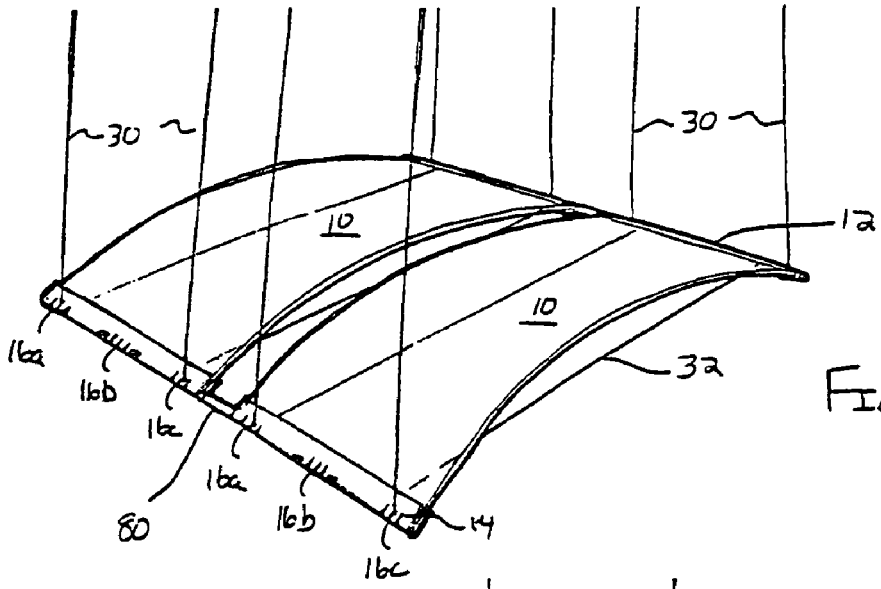
FIG. 3 is a perspective view of a second alternative configuration of the panel structure showing two panels suspended from the ceiling and spaced from each other.

Referring now in greater detail to the figures, wherein like numerals refer to like parts throughout the drawings. The present invention generally includes a flexible panel having edge strips. The flexible panel and edge strips are supported by support members and are maintained in a flexed configuration by biasing members. The support members and biasing members are shown in the drawings as cables. Thus, for ease of description and understanding, the support members and biasing members will hereafter be referred to as support cables and biasing cables respectively. However, it should be noted that the support and biasing members are not limited to cables and may be made from other materials having the appropriate strength characteristics desired, such as metal rods, wire or monofilament.

Figure 1:
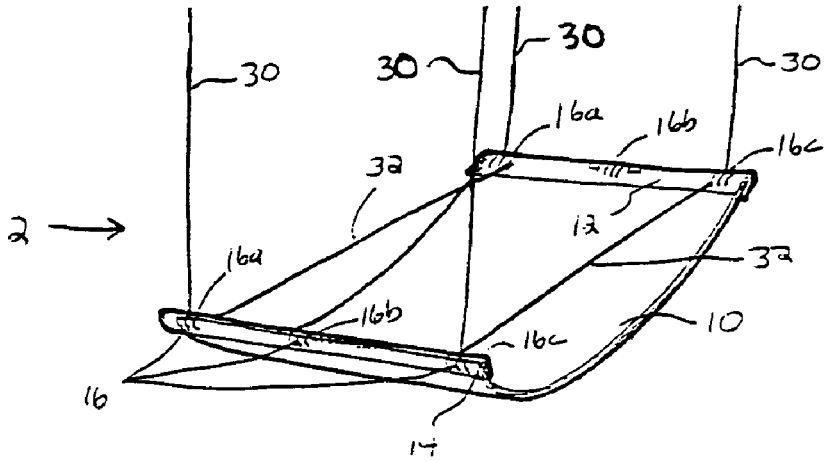
FIG. 1 is a perspective view of a panel structure embodying principles of the present invention, showing one panel flexed and suspended from the primary building structure.

As shown in FIG. 1, the panel structure 2 includes a flexible panel 10, a first edge strip 12 which cooperates with a first edge portion of the flexible panel 10 and a second edge strip 14 which cooperates with a second edge portion of the flexible panel 10. Support cables 30*a-d* and biasing cables 32 are secured to mounting member receiving areas 16 provided on the first and second edge strips 12, 14. The support cables 30 are typically connected to ceiling structures, such as the primary building structure or a suspended grid system. However, the support cables 30 may be connected to walls or other suitable structures.

Figure 2:
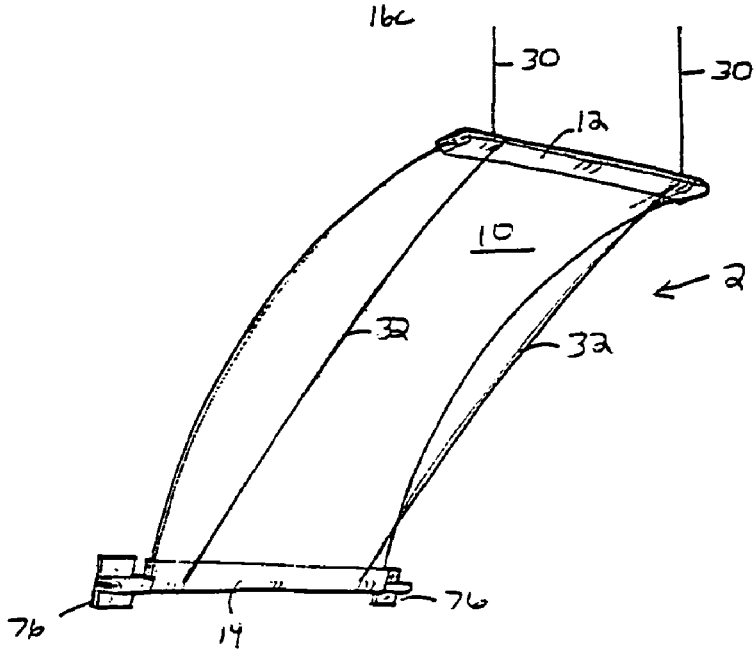
FIG. 2 is a perspective view of a first alternative configuration of the panel structure showing one panel secured to a wall at one side and suspended from the primary building structure on the other side.

FIGS. 2 and 12 show panel structures 2 which are mounted differently. As best shown in FIG. 2, the panel structure 2 is mounted to the primary building structure at a first end and to a wall at a second opposite end. As shown in FIG. 3, the panel structure 2 illustrated in FIG. 1 can be rotated and mounted in a position which is essentially 180 degrees from the panel structure shown in FIG. 1. Each of the panel structures shown in FIG. 3 has the same components as the panel structure shown in FIG. 1, except the flexible panels 10 are configured to flex upward toward the ceiling rather than downward.

Figure 6:
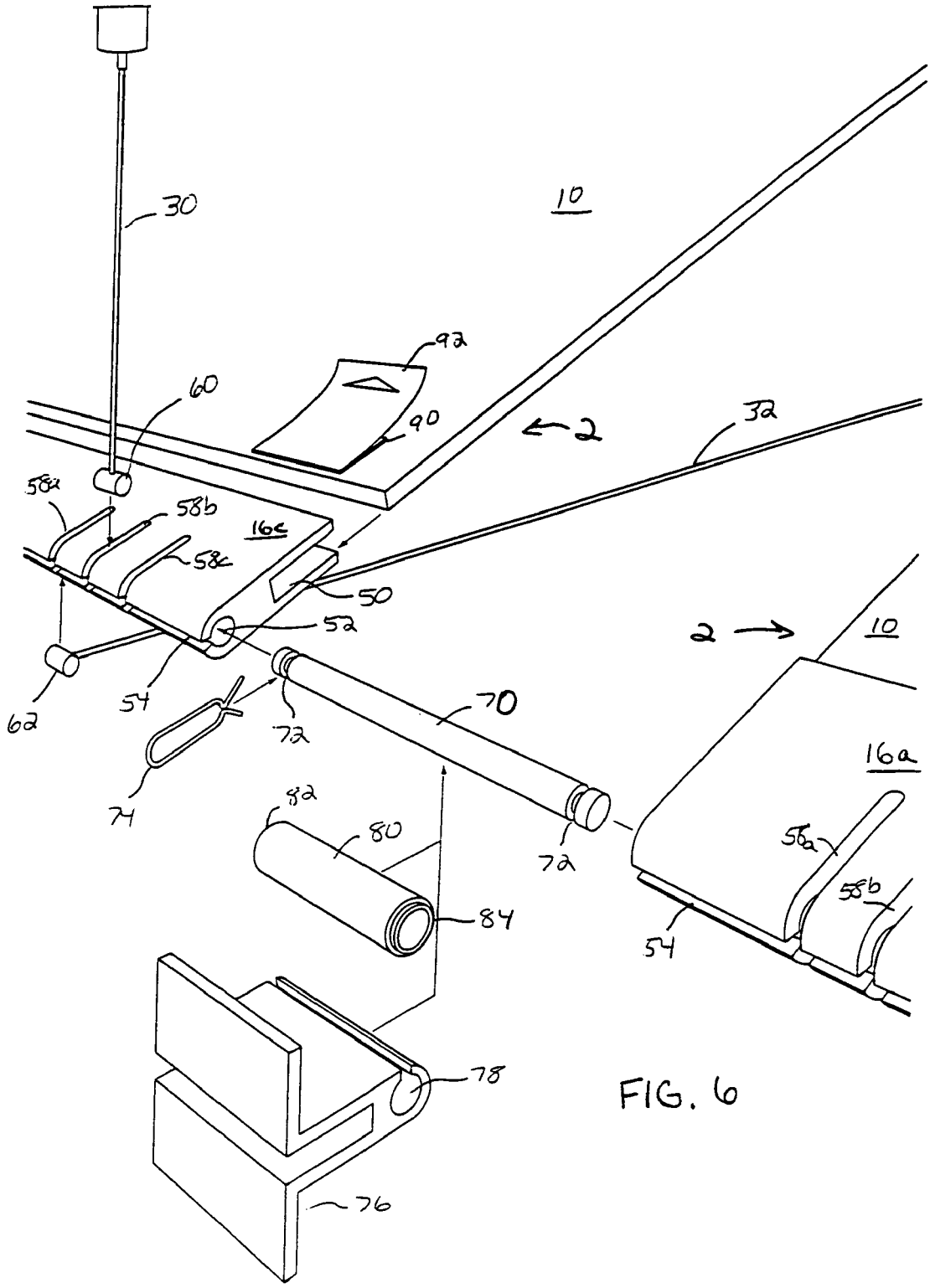
FIG. 6 is an exploded perspective view of a portion of the panel structure of FIG. 3 showing the various components thereof, with some of the components being used in different embodiments of the invention.

Referring to FIG. 6, various components of the ceiling structure of the invention are shown. It should be noted that these components are used for the different embodiments shown in other figures, and are not necessarily used in conjunction with each other.

The first edge strip 12 is the same as the second edge strip 14. For ease of description and understanding, the second edge strip 14 will be described in detail. Accordingly, the description of the second edge strip 14 applies equally to the first edge strip 12.

Figure 8:
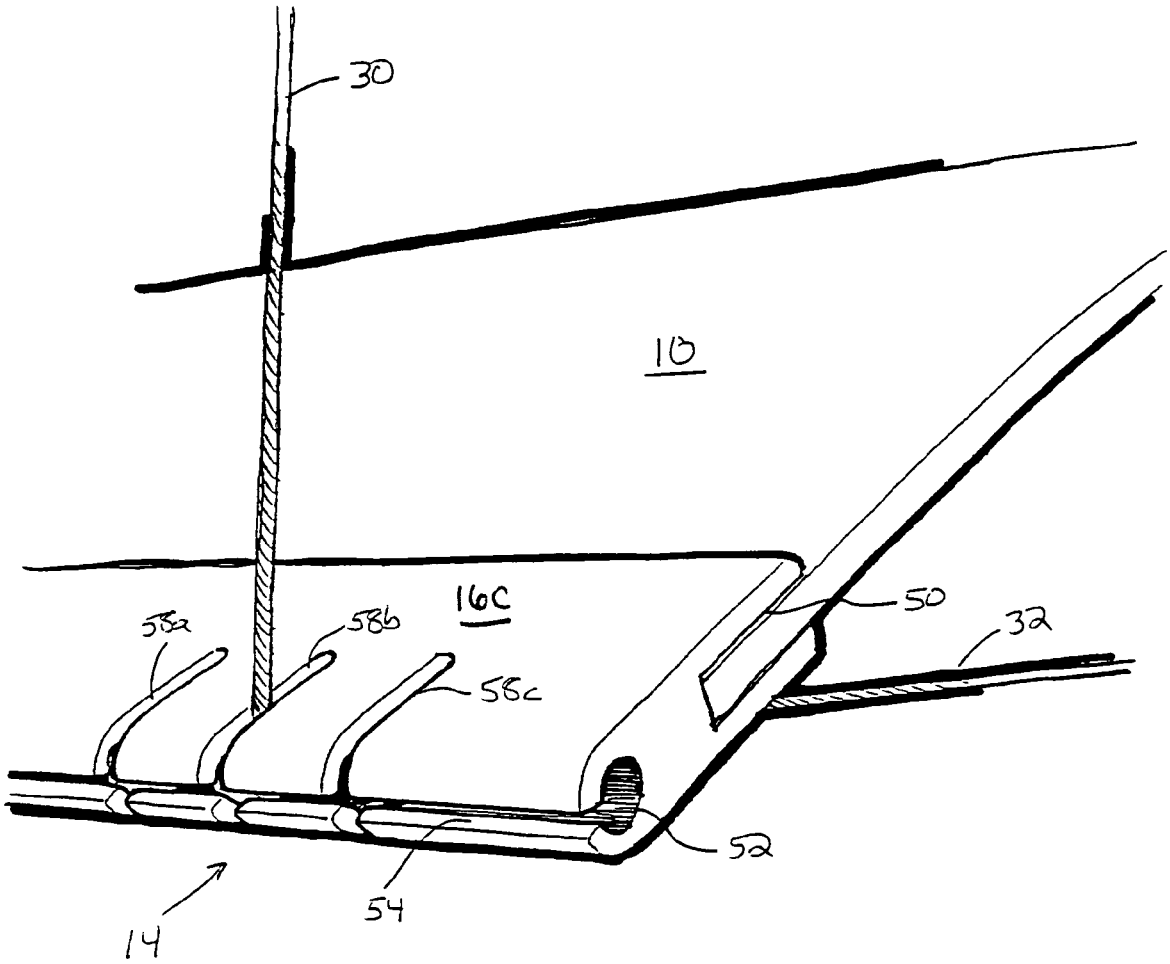
FIG. 8 is an enlarged perspective view of a support member extending from the edge strip.

As shown in FIG. 6, the second edge strip 14 has a panel receiving recess 50 which extends the entire length of the strip 14. The recess 50 is dimensioned to receive an edge of the panel 10 therein. As shown in FIG. 8, the spacing between the side walls of the recess 50 is dimensioned to be slightly greater than the thickness of the panel 10 to allow the panel 10 to be inserted into the recess 50.

An arcuate channel 52 also extends the entire length of the strip 14. As shown in FIGS. 6 and 8, the arcuate channel 52 is spaced from the recess 50 and is positioned proximate and parallel to an edge of the strip 14. A longitudinal slot 54 extends from the arcuate channel 52 to the edge of the strip 14. The slot 54 is dimensioned such that the spacing between the side surfaces of the slot 54 is less than the diameter of the arcuate channel 52.

As illustrated in FIG. 1, the second edge strip 14 has at least one mounting member receiving area 16 provided thereon. In the embodiments illustrated throughout the figures, three mounting member receiving areas 16*a*, 16*b*, 16*c* are shown. Mounting member receiving areas 16*a* and 16*c* are positioned proximate the ends of the strip 14 and mounting member receiving area 16*b* is positioned between mounting member receiving areas 16*a* and 16*c*, and is preferably proximate the center of the edge strip 14. The mounting member receiving areas in which the mounting members are attached can vary depending on the load to be supported and/or the decorative appearance sought. For example, cables 30, 32 may extend from mounting member receiving area 16*b*, rather than from 16*a* and 16*c* in systems in which the panel structures are interconnected.

Figure 7:
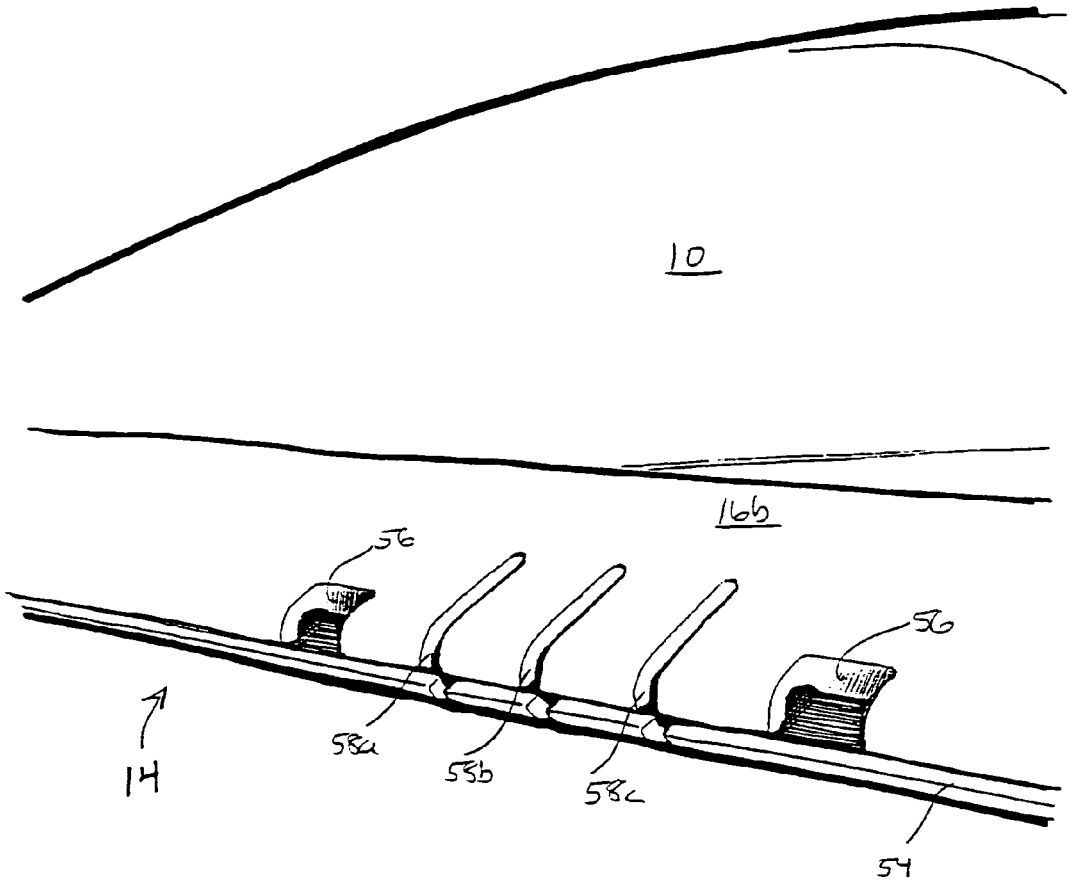
FIG. 7 is an enlarged perspective view of a mounting member receiving area of an edge strip.

FIG. 7 depicts mounting member receiving area 16*b* which is positioned proximate the center of the strip 14. In order to properly position the cables 30, 32 with respect to mounting member receiving area 16*b*, as will be more fully discussed below, enlarged receiving cavities 56 are provided adjacent the mounting member receiving area 16*b*. The receiving cavities 56 extend from the arcuate channel 52 and intersect with the longitudinal slot 54.

In the embodiments shown, each mounting member receiving area 16*a*, 16*b*, 16*c* has three mounting member receiving slots, 58*a*, 58*b*, 58*c*, which extend from the edge of the strip 14 to the arcuate channel 52. The longitudinal axis of each receiving slot is essentially perpendicular to the longitudinal axis of the arcuate channel 52. While three receiving slots are shown, various numbers and configurations of slots may be provided without departing from the scope of the invention. As illustrated in FIGS. 7 and 8, the strip 14 has rounded or arcuate edges proximate the slot 54. The arcuate edges facilitate the insertion of the cables in slots 58*a*, 58*b*, 58*c* while also providing a visually appealing appearance.

As shown in FIG. 6, the support cables 30 have mounting cylinders 60 attached to the ends thereof. The mounting cylinders 60 can be attached to the cables 30 using various techniques known in the industry. The diameter of a cylinder 60 is designed to be slightly less than the diameter of the arcuate channel 52, thereby allowing the cylinder 60 to be inserted into and move in the channel 52 in the direction of the longitudinal axis of the channel. Similarly, biasing cables 32 have mounting cylinders 62 attached to the ends thereof. The mounting cylinders 62 can be attached to the cables 32 using various techniques known in the industry. The diameter of the cylinder 62 is designed to be slightly less than the diameter of the arcuate channel 52, thereby allowing the cylinder 62 to be inserted into and move in the channel 52 in the direction of the longitudinal axis of the channel. Although the mounting cylinders 60 and 62 are represented to be of similar shape and dimension, different configurations of the mounting cylinders are possible without departing from the scope of the invention.

The mounting cylinder 62 of a respective biasing cable 32 is inserted into the arcuate channel 52 through a first end of the strip 14 or through the enlarged receiving cavities 56. The cylinder 62 is then slid in the longitudinal direction of the strip 14 and into alignment with a mounting member receiving area 16, for example, mounting member receiving area 16*c* as shown in FIG. 6. In order to allow the cylinder 62 to be moved into position, the biasing cable 32 must be able to extend through the longitudinal slot 54. With the biasing cable 32 properly positioned, the cylinder 62 is rotated to allow the cable 32 to extend through one of the mounting member receiving slots 58*a*, 58*b*, 58*c*. This same process described above is repeated to allow a second cable 32 of a second mounting cylinder 62 to be positioned into one of the mounting member receiving slots of one of the remaining mounting member receiving areas 16 of the edge strip 14.

Figure 9:
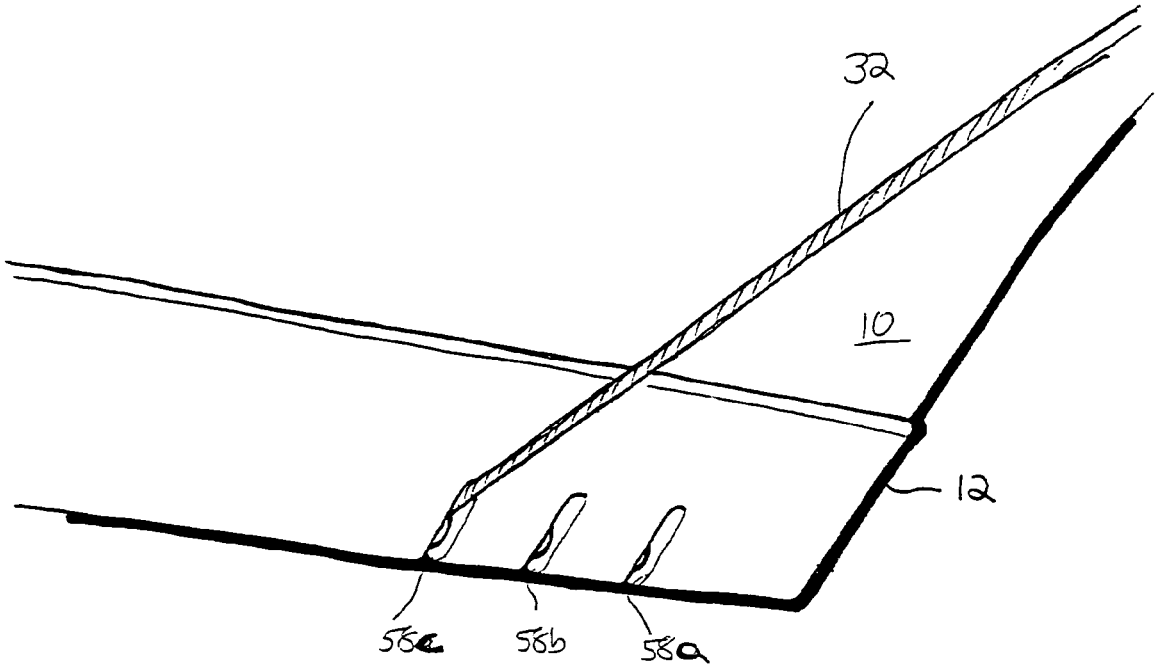
FIG. 9 is an enlarged perspective view of a biasing member extending from the edge strip.
Figure 10:
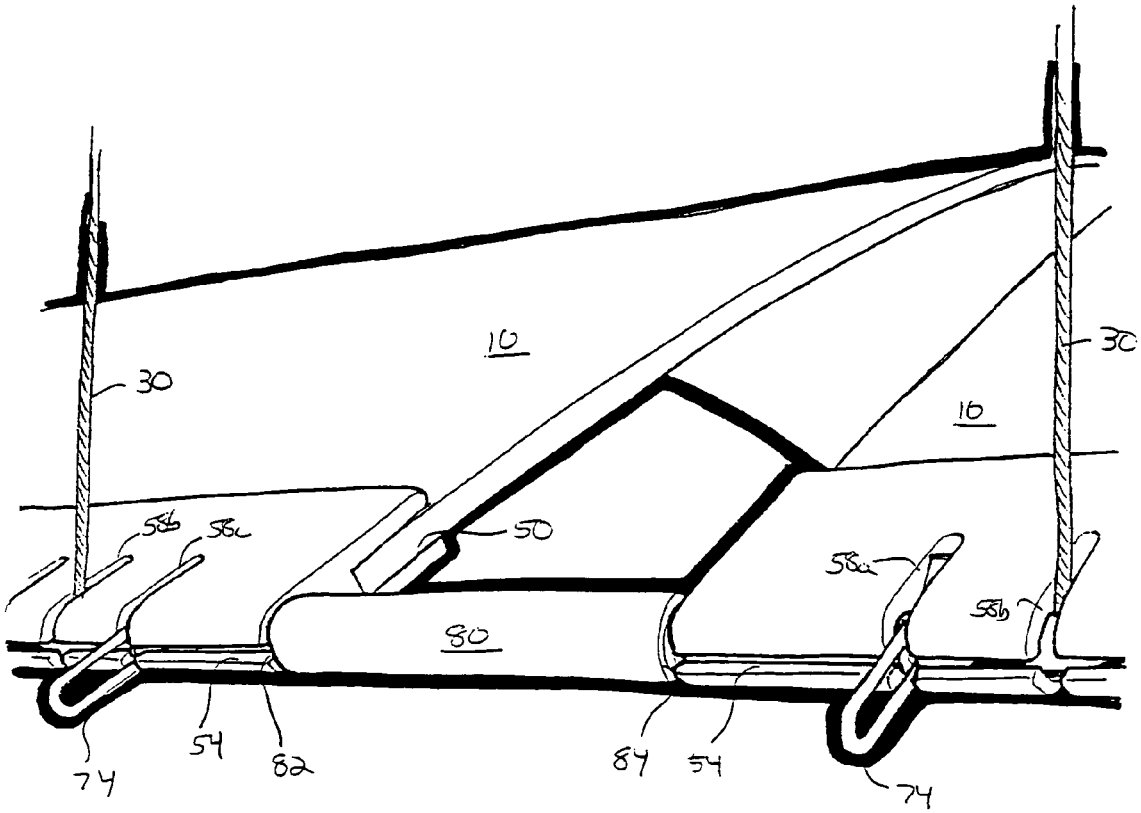
FIG. 10 is an enlarged perspective view of a spacing member positioned between panel structures and secured to the respective edge strips thereof.

With the first end of the biasing cable 32 positioned in a receiving slot, for example receiving slots 58*a* of mounting area 16*c*, the flexible panel 10 is bent and the second end of the biasing cable 32 is inserted into receiving slot 58*c* of mounting area 16*a* of the first edge strip 12 as shown in FIG. 9. The process of positioning the cables 32 in the first edge strip 12 is essentially identical to that described above. It is important to note that during insertion of a mounting cylinder 62 into the arcuate channel 52 of first edge strip 12, the panel 10 is flexed beyond its final configuration to allow the biasing cables 32 to be inserted into the arcuate channel 52 under minimal stress. However, the particular order in which the two mounting cylinders 62 of a biasing cable 32 are inserted into the arcuate channel 52 is not critical to the scope of the invention.

Once all of the mounting cylinders 62 of the biasing cables 32 are properly positioned, the flexible panel 10 is released. As the flexible panel 10 has been maintained in a stressed condition, the flexible panel attempts to return to an unstressed position when released. As this occurs, the biasing cables 32 are brought to a taught position, thereby preventing the further movement of the panel 10 toward its unstressed position and maintaining the panel 10 in the desired aesthetic position. The biasing cable 32 can be manufactured in different lengths. Different length biasing cables 32 create varied aesthetic appearances. For example, the longer the biasing cable 32, the more the panel 10 is allowed to return toward its unstressed or flat position.

With the panel 10 maintained in the appropriate aesthetic configuration, the curved panel is then mounted or suspended from the primary building structure. As shown in FIGS. 6 and 8, the mounting cylinder 60 of a respective support cable 30 is inserted into the arcuate channel 52 through a first end of the strip 14. The cylinder 60 is then slid in the longitudinal direction of the strip 14 until it is in alignment with the mounting member receiving area, e.g. 16*c*. To allow the cylinder 60 to be moved into position, the support cable 30 must be able to extend through the longitudinal slot 54.

With the support cable 30 properly positioned, the cylinder 60 is rotated to allow the support cable 30 to extend through one of the mounting member receiving slots 58*a*, 58*b*, 58*c* of receiving area 16. This same process is repeated to attach a second support cable into a second cable receiving area of the second edge strip 14, e.g. 16*a*. In the same manner, a third support cable and fourth support cable are attached to corresponding cable receiving areas of first edge strip 12. Once all four support cables 30 have been properly positioned and secured to the edge strips, as well as to the primary building structure, the panel structure 2 is properly mounted. While FIGS. 1 and 3 illustrate the embodiment having four support cables, other configurations are possible. Additionally, the lengths of the support members 30 can be varied to provide a variety of heights and orientations in order to provide a wide variety of visual and acoustical results.

Mounting member receiving slots 58*a*, 58*b* and 58*c* can be used for more than support members and biasing members. For example, in areas where seismic activity occurs, additional mounting members for seismic restraint may be added. Additional mounting member receiving slots can also be provided for other uses.

FIGS. 3, 5, 6 and 10 illustrate how two panel structures 2 may be joined together in a spaced apart relationship. A pin 70, as shown in FIG. 6, is slid into the arcuate channel 52 of an edge strip of a first panel structure. The pin 70 is dimensioned to be received in arcuate channel 52 in a similar manner as the mounting cylinders 60, 62. Each pin 70 has at least one clip receiving recess 72 which extends about the circumference of the pin 70 proximate an end thereof. The pin 70 is slid in the arcuate channel 52 until the clip receiving recess 72 of the pin is aligned with a support member receiving slot 58*a*, 58*b*, 58*c*. For example, the clip receiving recess 72 may be aligned with slot 58*c* of mounting member receiving area 16*a* or slot 58*a* of mounting member receiving area 16*c*.

To maintain the pin 70 in position, a clip 74 is inserted into the respective receiving slot 58*a*, 58*b*, 58*c* and into resilient engagement with the clip receiving recess 72 of the pin. A spacer 80 is then slid over the free end of the pin 70 until a first end 82 of the spacer 80 engages the end of the strip 14. The spacer 80 is a cylindrical member having an inside diameter greater than the diameter of the pin 70, thereby allowing the spacer 80 to freely move relative to the longitudinal axis of the pin 70. The pin is dimensioned to allow the exposed end of the pin to project beyond the spacer. With the spacer 80 properly inserted onto the pin 70, a second adjacent panel structure is moved into engagement with the free end of the pin 70. Specifically, the free end of the pin 70 is slid into the arcuate channel 52 of the edge strip 14 of the adjacent panel structure 2 until the clip receiving recess 72 of the pin is aligned with a support member receiving slot 58*a*, 58*b*, 58*c*. As described above, the pin 70 is retained in arcuate channel 52 by a clip 74.

With the pin 70 properly retained, the first end 82 of the spacer 80 is in close proximity to the strip 14 of the first panel and the second end 82 of the spacer 80 is in close proximity to the strip 14 of the second panel. While the spacer 80 may engage the strips 14 of adjacent panel structures 2, it is not necessary that this occur. The same process would be repeated at the opposite end of the panel structures 2, thereby providing a spacer between strips 12 of adjacent panel structures. The use of the spacers 80 allows installers of the panel structures to easily align and connect the panel structures. The spacers 80 also add to the aesthetic value of the system.

Figure 11:
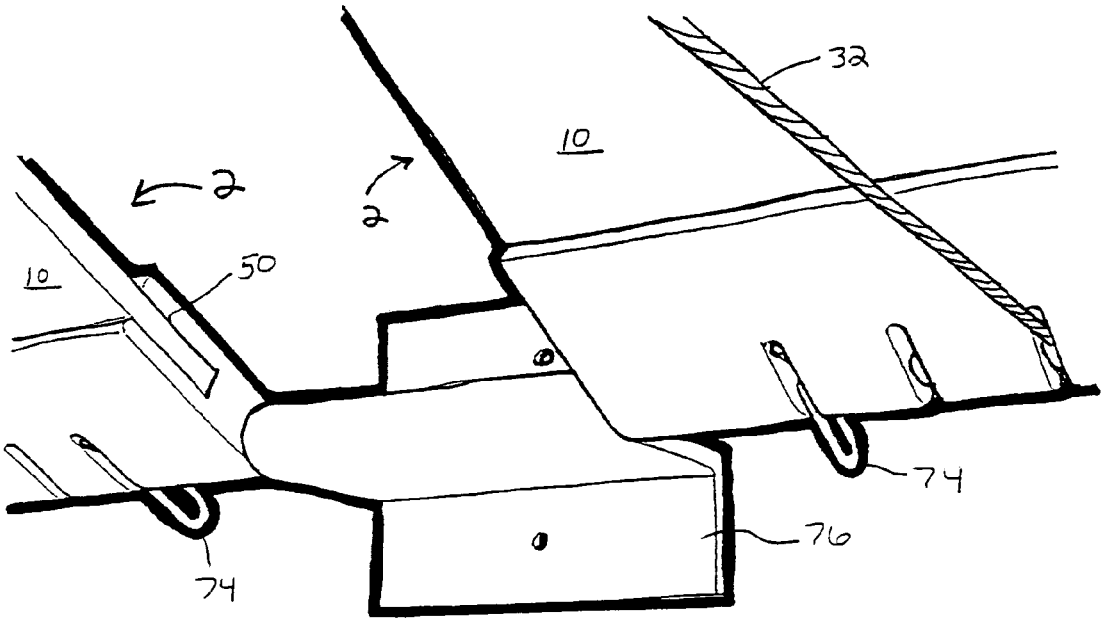
FIG. 11 is an enlarged perspective view of a mounting bracket positioned between panel structures and secured to respective edge strips thereof.

FIGS. 2 and 11 display an alternate example embodiment in which a first edge of the panel structure 2 is mounted to a wall and the other edge to the primary building structure as described above. To mount a first edge of a panel structure 2 to a wall, a pin is inserted into both ends of the edge strip 14 as previously described. As shown in FIGS. 2, 6 and 11, a mounting bracket 76 is then positioned over the portion of the pin 70 which extends beyond the strip 14. A pin receiving recess 78 is provided in the bracket 76 to house the pin 70 therein. The recess 78 has similar dimensions as the arcuate channel 52. A respective bracket 76 is mounted on either side of the strip 14 to properly mount and maintain the panel in position relative to the wall.

The mounting bracket 76 can also be used as a spacer to properly space adjacent panel structures 2 from each other. As shown in FIGS. 2, 6 and 11, a pin 70 which is dimensioned to extend from either side of the bracket 76, is positioned in the recess 78. The clip receiving recesses 72 of the pin are positioned proximate either end of the pin 70 to allow two respective panel structures 2 to be secured to the pin as described above. In this embodiment, the mounting bracket 76 mounts the panel structures 2 to the wall and provides the spacing required to enhance the aesthetic appeal of the structures.

As previously discussed, the panel receiving recess 50 has slightly larger width than the thickness of the panel 10 to allow the edge of the panel to be inserted into the recess without causing damage to the panel. Once assembled, with the panel maintained in a stressed position, the panel 10 and the edge strip 14 exert forces on each other to prevent the strip from being removed from the panel. However, these forces are exerted in a direction which is substantially perpendicular to the longitudinal axis of the recess and, therefore, do not prevent movement or sliding of the panel in a direction parallel to the longitudinal axis. To prevent movement in the parallel direction, a two-sided tape 90 may be adhered to the panel 10. The tape 90 is located proximate the edge of the panel 10 being inserted into the panel receiving recess 50. Adhesive properties are provided on both major surfaces of the tape so that the tape will adhere to a respective side wall of the panel receiving recess 50.

A cover 92 is provided on the surface of the tape 90 that cooperates with the respective side wall of the panel receiving recess 50. When the panel 10 is properly inserted, the cover 92 of the tape 90 is removed to expose the top adhesive coating of the tape. With the cover 92 removed, the tape adheres to the side wall of the recess 50, thereby preventing the sliding movement of the panel. The number of pieces of tape 90 and their location is determined by the size of the panels and the characteristics desired. It is important to note that the cover 92 is designed to be removed after the edge of the flexible panel 10 is inserted into the panel receiving recess 50. Consequently, a portion of the cover 92 must extend beyond the recess 50 when the panel 10 and recess 50 are placed in engagement. In addition, the cover 92 is configured to allow removal thereof in a minimal space.

While tape 90 is disclosed and shown in the figures, other means of securing the panel in the recess 50 can be used without departing from the scope of the invention. Such other means include adhesives, clips and mechanical fasteners.

To provide access to the space above the structure without completely disassembling the system, the panel structure 2 may be hingedly or pivotally rotated by removing the support members 30 from one end of the panel structure and pivoting the panel structure about the end which is attached to the support members 30.

The panel structures 2 of the present may also be used in conjunction with a light source in order to illuminate the space in which the structure is suspended or mounted. The light may be integrally formed with the panel structure, such as being supported by one or more cables, or be positioned adjacent the structure in order for the flexible panel to act as a reflector, diffuser or shade for a light source.

When installed, the panel structure provides a canopy-like visual element to a space in which it is suspended or mounted. The panel structure may be easily installed and reconfigured to suit the user. The elements of the panel structure may be interchanged in order to provide different functionality (such as lighting or acoustics) or different visual and aesthetic impact. The flexible panel may be provided in a variety of shapes, materials and finishes. The flexible panel may be formed of wood, paper, metal, plastic, glass or any other suitable material. The panel may be solid, mesh or include a variety of decorative designs or openings therein to provide the desired visual impact. As previously noted, the cables may be made of various material and may be provided in varying lengths to enhance the visual impact.

Various other alternative materials, securing methods, profiles and configurations can be used without departing from the scope of the invention. Other changes in construction will occur to those skilled in the art and various apparently different modifications and embodiments may be made without departing from the scope of the invention. The matter set forth in the foregoing description and accompanying drawings is offered by way of illustration only. It is therefore intended that the foregoing description be regarded as illustrative rather than limiting.

What is claimed is:

1. A panel structure comprising:

a flexible panel having a first side edge and a second side edge, the first and second side edges being opposing edges of the flexible panel;

first and second edge strips, the first edge strip cooperating with the first side edge of the flexible panel and the second edge strip cooperating with the second side edge of the flexible panel, the first and second edges strips each having at least one mounting member receiving area provided thereon, the at least one mounting member receiving area being dimensioned to receive a mounting member therein; and a biasing member having first and second opposed ends, the first end of the biasing member being attached to the first edge strip and the second end of the biasing member being attached to second edge strip to maintain the panel in a flexed configuration, wherein each of the first and second edge strips has a panel receiving recess extending from an edge thereof, the panel receiving recess having opposed side walls, the opposed side walls being spaced apart from one another at a distance which is slightly larger than the thickness of the flexible panel, whereby the flexible panel can be easily inserted into the panel receiving recess, wherein each of the first and second edge strips has an arcuate channel is provided therein, the arcuate channel being spaced from the panel receiving recess and positioned proximate to an edge of the strip, wherein a longitudinal slot extends from the arcuate channel to the edge of the strip, the longitudinal slot being dimensioned such that the spacing between side surfaces of the longitudinal slot is less than the diameter of the arcuate channel, wherein an enlarged receiving cavity is provided proximate the mounting member receiving area, the enlarged receiving cavity extending from the arcuate channel and intersecting the longitudinal slot.

2. A panel structure comprising:

a flexible panel having a first side edge and a second side edge, the first and second side edges being opposing edges of the flexible panel;

first and second edge strips, the first edge strip cooperating with the first side edge of the flexible panel and the second edge strip cooperating with the second side edge of the flexible panel, the first and second edges strips each having at least one mounting member receiving area provided thereon, the at least one mounting member receiving area being dimensioned to receive a mounting member there; and a biasing member having first and second opposed ends, the first end of the biasing member being attached to the first edge strip and the second end of the biasing member being attached to second edge strip to maintain the panel in a flexed configuration, wherein each of the first and second edge strips has a panel receiving recess extending from an edge thereof, the panel receiving recess having opposed side walls, the opposed side walls being spaced apart from one another at a distance which is slightly larger than the thickness of the flexible panel, whereby the flexible panel can be easily inserted into the panel receiving recess, wherein each of the first and second edge strips has an arcuate channel is provided therein, the arcuate channel being spaced from the panel receiving recess and positioned proximate to an edge of the strip, wherein at least one mounting member receiving slot is provided in the mounting member receiving area, the at least one mounting member receiving slot extending through the surface of the strip and into the arcuate channel, the longitudinal axis of the at least one mounting member receiving slot being essentially perpendicular to the longitudinal axis of the arcuate channel.

3. The panel structure of claim 2, wherein a mounting cylinder is attached to each end of the biasing member, the diameter of the mounting cylinder being less then the diameter of the arcuate channel, whereby the mounting cylinder can be inserted into and move in the arcuate channel in the direction of the longitudinal axis of the arcuate channel.

4. A suspended ceiling structure comprising:

a flexible panel;

a strip, the strip cooperating with an edge portion of the flexible panel and having at least one mounting member receiving area provided thereon, the at least one mounting member receiving area having at least one receiving slot and being dimensioned to receive a mounting member therein, and wherein an arcuate channel is provided in the strip, the arcuate channel being spaced from the panel receiving recess and positioned proximate to an edge of the strip;

a mounting member, the mounting member cooperating with the strip to maintain the flexible panel; and a pin, the pin being insertable into a respective end of the arcuate channel and having at least one clip receiving recess provided thereon proximate an end of the pin, the clip receiving recess being alignable with the at least one mounting member receiving slot.

5. The suspended ceiling structure of claim 4, comprising a clip, the clip being insertable through the at least one mounting member receiving slot, the clip cooperating with the clip receiving recess to maintain the pin in position relative to the panel structure.

6. The suspended ceiling structure of claim 5, comprising a mounting bracket, the mounting bracket cooperating with an exposed end of the pin, the pin being dimensioned to allow the exposed end of the pin to project beyond the mounting bracket, whereby as the mounting bracket is mounted to a surface, the cooperation of the pin with the mounting bracket maintains the panel structure in position relative to the surface.

7. The suspended ceiling structure of claim 5, comprising a spacer, the spacer cooperating with an exposed end of the pin, the pin being dimensioned to allow the exposed end of the pin to project beyond the spacer, whereby as a second panel structure is moved proximate the free end of the pin, the pin and spacer cooperating with the second panel structure to maintain the second panel structure in proper position with respect to the first panel structure.

* * * * *

UNITED STATES PATENT AND TRADEMARK OFFICE

CERTIFICATE OF CORRECTION

PATENT NO. : 7,406,802 B2
APPLICATION NO. : 10/802620
DATED : August 5, 2008
INVENTOR(S) : Stackenwalt et al.

It is certified that error appears in the above-identified patent and that said Letters Patent is hereby corrected as shown below:

Column 9
Claim 2, Line 27, The word "there" should be --therein--

Signed and Sealed this

Eleventh Day of November, 2008

JON W. DUDAS
*Director of the United States Patent and Trademark Office*